US011338408B2

(12) United States Patent
Wortley

(10) Patent No.: US 11,338,408 B2
(45) Date of Patent: May 24, 2022

(54) POSITIONING DEVICE FOR APPLYING AN OBJECT TO A GRINDER AT PRE-DETERMINED ANGLES

(71) Applicant: Steven Duane Wortley, Brighton, MI (US)

(72) Inventor: Steven Duane Wortley, Brighton, MI (US)

(73) Assignee: Steven D. Wortley, Brighton, MI (US)

( * ) Notice: Subject to any disclaimer, the term of this patent is extended or adjusted under 35 U.S.C. 154(b) by 232 days.

(21) Appl. No.: 16/401,137

(22) Filed: May 2, 2019

(65) Prior Publication Data

US 2020/0346316 A1 Nov. 5, 2020

(51) Int. Cl.
*B24B 9/16* (2006.01)

(52) U.S. Cl.
CPC ..... *B24B 9/161* (2013.01)

(58) Field of Classification Search
CPC ..... B24B 9/161
USPC ..... 451/389
See application file for complete search history.

(56) References Cited

U.S. PATENT DOCUMENTS 515,595 A * 2/1894 Linden ..... B24B 9/161 451/389
558,734 A * 4/1896 Loesser ..... B24B 9/161 451/389
698,521 A * 4/1902 Kneip ..... B24B 9/161 451/389
701,879 A * 6/1902 Hilliard ..... B24B 9/161 451/389
925,016 A * 6/1909 McMullen ..... B24B 9/161 451/389
1,838,423 A * 12/1931 Loesser ..... B24B 9/161 451/389
1,958,021 A * 5/1934 Schmidt ..... B24B 9/161 451/369
2,444,795 A * 7/1948 Weir ..... G04D 3/0058 451/389
2,779,138 A * 1/1957 Collar ..... B24B 9/16 451/275
3,073,085 A * 1/1963 Ticino ..... B24B 9/16 451/389
3,098,327 A * 7/1963 Malin ..... B24B 9/16 451/278
3,135,073 A * 6/1964 Odle ..... B24B 9/16 451/389
3,435,569 A * 4/1969 Stanley ..... B24B 9/16 451/389
3,439,456 A * 4/1969 Bailey ..... B24B 9/16 451/278

(Continued)

*Primary Examiner* — Joshua E Rodden
(74) *Attorney, Agent, or Firm* — Quinn IP Law

(57) ABSTRACT

One embodiment of a device for positioning an object to be ground independent of the grinding tool having an armature shaft for holding an object, mounted by means of an armature and armature collar and attached to a mast, which is attached to a base. The armature shaft is used to position the object to be ground at a face angle determined by the combination of the vertical positioner length of the armature relative to the surface of the independent grinding tool. The rotational angle of the object to the grinding tool is set and can be repeated as needed by the indexed angle selector and the keyed receiver.

13 Claims, 3 Drawing Sheets

(56) References Cited

U.S. PATENT DOCUMENTS

| | | | | | |
|---|---|---|---|---|---|
| 3,559,349 | A | * | 2/1971 | Imahashi | B24B 19/16 451/389 |
| 3,688,452 | A | * | 9/1972 | Stevens | B24B 9/16 451/389 |
| 3,818,641 | A | * | 6/1974 | Long | B24B 9/16 451/279 |
| 3,940,888 | A | * | 3/1976 | Wain | B24B 9/16 451/389 |
| 3,992,821 | A | * | 11/1976 | Hoffman | B24B 9/16 451/278 |
| 4,955,162 | A | * | 9/1990 | Jackson | B24B 9/16 451/279 |
| 5,058,324 | A | * | 10/1991 | Snellen | B24B 9/16 451/276 |
| 5,297,362 | A | | 3/1994 | Wykoff | |
| 5,435,774 | A | | 7/1995 | Naujok | |
| 5,454,747 | A | | 10/1995 | Ascalon | |

* cited by examiner

POSITIONING DEVICE FOR APPLYING AN OBJECT TO A GRINDER AT PRE-DETERMINED ANGLES

CROSS-REFERENCE TO RELATED APPLICATIONS

This application claims the benefit of provisional patent Application No. 62/762,345, filed May 1, 2018 which is hereby incorporated by reference.

BACKGROUND

The following references are provided: U.S. Pat. No. 3,940,888 to Wain; U.S. Pat. No. 4,955,162 to Jackson; U.S. Pat. No. 5,297,362 to Wykoff; U.S. Pat. No. 5,435,774 to Nanjok; and U.S. Pat. No. 5,454,747 to Ascalon.

Current devices for applying an object to a grinder at pre-determined angles are holistic devices incorporating a faceting arm and grinding surface and are generally built for gemstones—for example, U.S. Pat. Nos. 4,955,162 and 5,297,362. As such, they are expensive, highly precise scientific instruments built for working small pieces. Some faceting arms have been proposed—for example, U.S. Pat. No. 5,435,774. This device allows for very precise manipulation of the object to be faceted but is not free-standing; a larger device is assumed.

Because of the expense and limited work area, artists and hobbyists often select a stand-alone flat grinder. With this device they work the object by hand. With respect to artists and hobbyists, the current faceting machines suffer from the following disadvantages: (a) The expense of the machines is a barrier for entry into faceting. The expense is compounded if the artist or hobbyist has already purchased a stand-alone flat grinder. (b) The current devices are limited in the size of the object that can be ground to relatively small pieces. (c) The alternative to the available faceting machines is to shape the object by hand on a stand-alone flat grinder. This approach limits the detail, precision and quality of the work that can be done. It can also result in serious injury to fingers.

SUMMARY

In accordance with one embodiment a device for applying an object to a grinder at predetermined angles comprises an independent base, a stable mast, an armature that can set a face angle by adjusting its height and length, a simple method for determining the face angle in clear terms, an interchangeable indexed angle selection body clearly indicating the degree of the facet, a keyed receiver for holding and repeating specific facet angles, and an armature lock that will secure the angle selection body into the keyed receiver.

Accordingly several advantages of one or more aspects are as follows: to provide a relatively inexpensive faceting solution, that allows face angles to be set by both the height and length of the armature, that allows the facet angle to be set and repeated throughout the process of grinding and polishing the object, that can be positioned and used independently with any flat grinder and that will allow free movement over the surface of the grinder. Other advantages of one or more aspects will be apparent from a consideration of the drawings and ensuing description.

DETAILED DESCRIPTION

Figure 1:
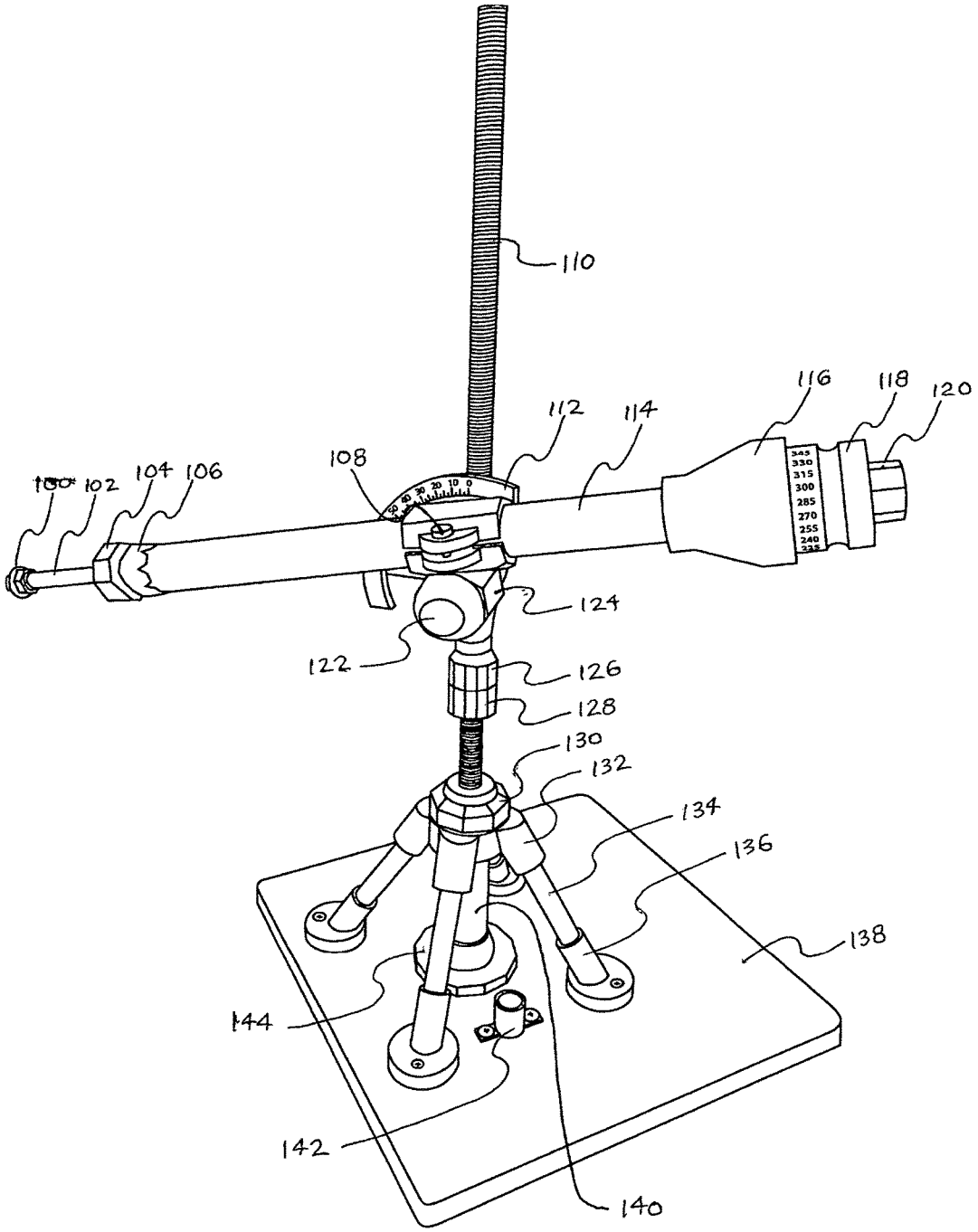
FIG. 1 shows the perspective view of the Invention showing the Base, Mast, the face angle indicator of the Vertical Collar, Armature Collar and Armature in accordance with one embodiment.
Figure 2:
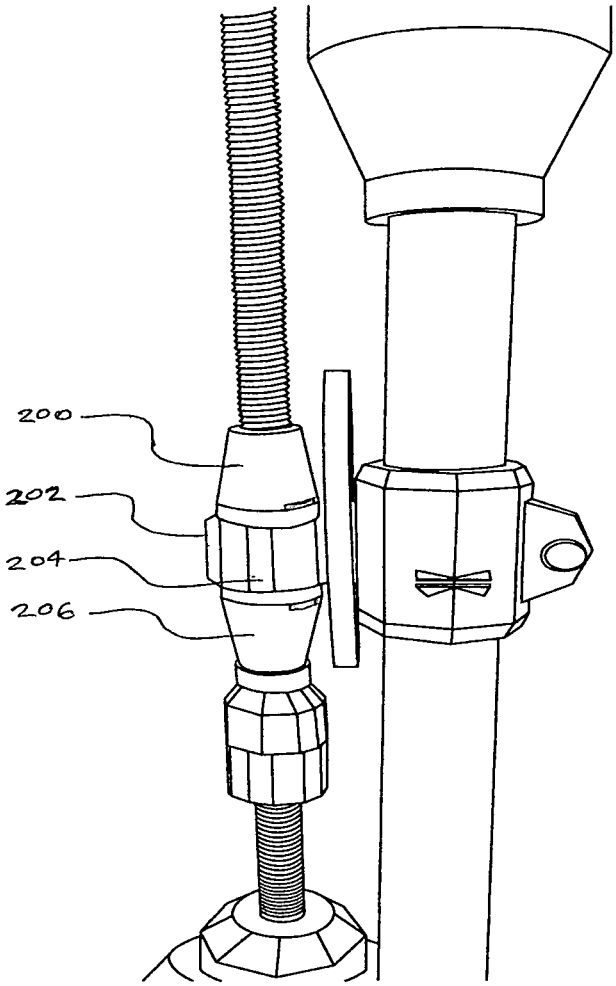
FIG. 2 shows the perspective view isolating the Vertical Height Mechanism and Vertical Collar.
Figure 3:
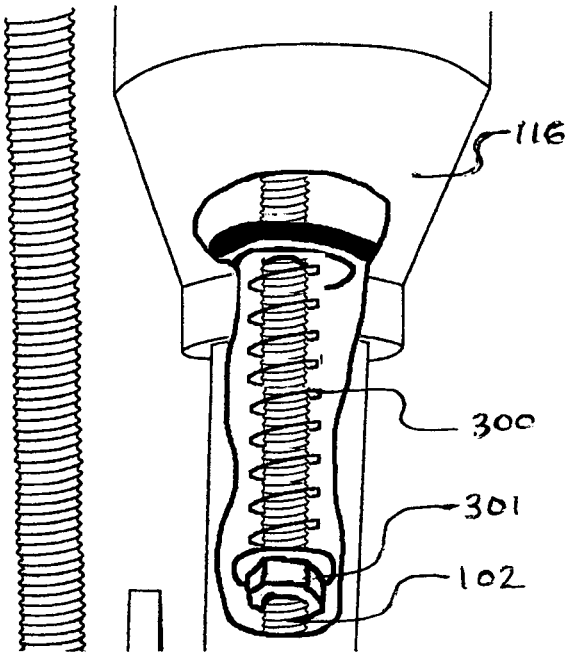
FIG. 3 shows the cut-away view isolating the Armature Compression Spring and Armature Compression Spring Tensioner.

In FIGS. 1-3, the following parts are illustrated: an object connector lock 100, an armature shaft 102, an armature shaft lock 104, an armature shaft sleeve 106, and armature collar tensioner 108, a mast 110, a face angle indicator 112, and an armature containment cylinder 114. The following parts are additionally illustrated: a facet angle receiver 116, a facet angle selector 118, a facet angle selector lock 120, an armature collar hubcap 122, an armature collar 124, a vertical height positioner 126, a vertical height lock 128, and a base tensioner 130. The following parts are additionally illustrated: an upper leg housing 132, a base leg 134, a leg stabilization foot 136, a base 138, a base housing 140, an armature shaft holder 142, a base stabilizer foot 144, an upper vertical collar sleeve 200, and a vertical collar cap 202. The following parts are additionally illustrated: a vertical collar 204, a lower vertical collar sleeve 206, an armature compression spring 300, a compression spring tensioner 301. The mast 110 is fitted through a hole in the base 138 and through the base housing 140. The base tensioner 130 is threaded onto the mast 110 and is tightened against the upper leg housing 132. The four base legs 134 are each fitted into a leg stabilization foot 136.

The object connector lock 100 is a lock bolt used to secure the dap holding the object to be ground.

The armature shaft 102 is a threaded rod supported by the armature shaft lock 104 and facet angle selector receiver 116. Connected to the armature shaft 102 is a spring mechanism, which acts in compression against the inside wall of the facet angle selector receiver 116. This allows the facet angle selector 118 to be retracted and the shaft rotated in order to select another facet angle. A portion of the rod is affixed with a hexagonal section, which provides a slip-fit mounting point for the facet angle selector 118.

The armature shaft lock 104 includes a nut captured within a hexagonal body. A cylindrical appendage protrudes from the hexagonal body, which provides a compression fit into the armature containment cylinder 114. Blocks protruding from the hexagonal body toward the cylindrical appendage dissipate the force of compression when the encapsulated bolt is tightened, seating the facet angle selector 118 into the facet angle receiver 116.

The armature shaft sleeve 106 is a circular crown that fits over the armature containment cylinder 114 to ensure the armature shaft lock 106 has an even compression surface.

The armature collar tensioner 108 is a bolt passing through the armature collar 124 and into an embedded nut that allows the armature collar 124 to be loosened such that the armature containment cylinder 114 can slide forward and back to aid in positioning the object to be ground.

The mast 110 is a threaded rod anchored to the base 138 that provides a stable, vertical platform for the armature.

The face angle indicator 112 press fits onto the vertical collar 204. Legs of the face angle indicator 112 support a curved surface embedded with marks indicating each angle from 0-90 degrees.

The armature containment cylinder 114 is a solid, hollow body that serves at mount points for the armature shaft lock 104, the armature collar 204 and the facet angle selector receiver 116. A groove runs 80% of the length of the cylinder from the back and fits the keys in the armature collar 204 and the facet angle selector receiver 116 to keep the armature from twisting.

The facet angle receiver 116 is a conical body used to connect the armature body 114 to the facet angle selector 118. A keyed socket provides a press fit for the armature body 114. The back of the keyed socket acts as a base for the armature shaft's 102 compression spring. The other side of the body flares out into a hollow recess with a key, which is the angle selection and locking mechanism for the facet angle selector 118.

The facet angle selector 118 is a conical body with grooves for each of the angles allowed, with the degree for each groove imprinted in the body of the facet angle selector 118. The front half of the body of the facet angle selector 118 has a hexagonal recess, which provides a locked slip fit onto the hexagonal portion of the armature shaft 102. The recess continues through the body of the facet angle selector 118 as a circular access for the armature shaft 102 and ends in a conical depression. The body of the facet angle selector 118 is locked into place using the facet angle selector lock 120, which fits into the conical depression at the rear of the body of the facet angle selector 118. By releasing the facet angle selector lock 120, this body of the facet angle selector 118 can be removed and replaced with another facet angle selector 118 with a different set of angles prescribed.

The facet angle selector lock 120 is a nut is captured within a conical body that leads to an octagonal body, which can be affixed to the armature shaft 102. The conical portion of the body of the facet angle selector lock 120 provides a compression fit into the conical recess at the rear of the facet angle selector 118, securing it onto the armature shaft 102.

The armature collar hubcap 122 is a nut is captured within a conical body that attaches to an axle of the vertical collar 204 running through the armature collar 124.

The armature collar 124 includes two bearings that are captured within a hexagonal housing, which mount onto the axle of the vertical collar 204. On top and 90 degrees opposed to the bearing housing is the upper housing, which grasps the armature containment cylinder 114. The upper housing is hexagonal and split along one side. A key runs along the bottom of the housing, which fits into the groove of the armature containment cylinder 114. A line is placed across the top of the upper housing, which is used to point at the face angle indicator.

The vertical height positioner 126 is nut is captured in an octagonal body with a conical top and rotated on the mast 110, which provides a base for the lower vertical collar sleeve. This is done to set the position of the vertical collar 204, which then sets the face angle of the armature with respect to the grinding device.

The vertical height lock 128 is a nut is captured in an octagonal body and rotated on the mast 110, which provides a lock for the vertical height positioner 126.

The base tensioner 130 is a nut and washer that are captured in an octagonal body and rotated on the mast 110 directly onto the upper leg housing 132, which puts the base housing 140 into compression, securing the mast 110.

The upper leg housing 132 is a body with four protruding, recessed cylinders used to provide upper support for the four base legs 134. The upper portion of the body is a flat surface used as a contact point for the base tensioner 130. The bottom has a cylindrical recess used as a press fit mounting point for the base housing 140.

Four base legs 134 each include a shaft running from the upper base housing 132 to a leg stabilization foot 136, which includes a pedestal with a hollow, cylindrical projection used as a press fit receptacle for the base leg 134. The pedestal has a cylindrical hole used to secure the body to the base 138.

The base 138 is a platform upon which the base stabilizer foot 144 and the four leg stabilization feet 136 are attached. A hole in the base provides access for the mast 110.

The base housing 140 is a hollow cylinder connecting the base stabilizer foot 144 and the upper base housing 132. The body provides a strong, stable stand for the mast 110 when under compression.

The armature shaft holder 142 is a cylindrical body with tabs used to place the end of the armature shaft 102 when not in use. The tabs have holes used to mount the body to the base 138.

The base stabilizer foot 144 is an octagonal body with a hollow, cylindrical protrusion used as a press fit connection for the base stabilizer leg 140. The body has four holes used to mount to the base 138.

The upper vertical collar sleeve 200 is a tapered, cylindrical body with a hexagonal protrusion at the bottom. The body contains a cylindrical recess for the mast 110. The hexagonal protrusion is press-fitted into the vertical collar 204.

The vertical collar cap 202 is a cylindrical body that press fits into the back of the vertical collar 204.

The vertical collar 204 is a hollow, cylindrical body with hexagonal recesses on the top and bottom to provide press fit access for the upper vertical sleeve 200 and lower vertical sleeve 206. The mast 110 passes through the body. A cylindrical protrusion with a hexagonal recess and cylindrical hole is used to mount the axle, which is used to attach the armature collar 124.

The lower vertical collar sleeve 206 is a tapered, cylindrical body with a hexagonal protrusion at the bottom. The body of the lower vertical collar sleeve 206 contains a cylindrical recess for the mast 110. The hexagonal protrusion is press-fitted into the vertical collar 204.

The armature compression spring 300 is a compression spring for seating the facet angle selector 118 into the facet angle receiver 116.

The compression spring tensioner 301 is a nut and washer secured to the armature shaft 102 to tension the armature compression spring 300 against the internal wall of the facet angle receiver 116.

The vertical height lock 128 is threaded onto the mast 110, with the vertical height positioner 126 above it. The user sets the vertical height positioner 126 in the desired location on the mast 110 and then tightens the vertical height lock 128 against the vertical height positioner 126 so that it remains stationary while the art piece is ground. The vertical sleeves 200 and 206 are press fit into the vertical collar 204, and the entire assembly is slipped snugly onto the mast 110 and rests on the vertical height positioner 126. This allows rotation around the mast 110 as the art piece is worked across the surface of the grinder.

The armature collar 124 is attached to an axle portion of the vertical collar 204, through bearings encapsulated within the armature collar 124. The armature collar 124 is held onto the axle bolt by means of a lock washer and the nut contained in the armature collar hubcap 122. The bearings and axle allow the art piece's face to be positioned smoothly onto the grinder at the desired angle. The angle indicator on top of the armature collar 204 points to the face angle indicator 112. The face angle indicator 112 is press fitted onto the vertical collar 204.

The armature containment cylinder 114 is held in compression by the armature collar 124 and the armature collar tensioner 108. A groove in the armature containment cylinder 114 slips into a key in the armature collar 124 to keep the armature containment cylinder 114 from twisting while working the art piece.

On one end of the armature containment cylinder 114, the armature shaft sleeve 106 is press fit onto the end of the armature containment cylinder 114. This is used to correct any blemishes in the end of the armature containment cylinder 114 and gives the armature shaft lock 104 a level compression surface. The armature shaft lock 104 is rotated onto the armature shaft 102 and is tightened against the armature shaft sleeve 106. The object connector lock 100 is threaded onto the end of the armature shaft 102.

The facet angle receiver 116 is press fit onto the armature containment cylinder 114. A key in an armature containment cylinder recess of the facet angle receiver 116 ensures the armature containment cylinder 114 does not twist while working the art piece. The armature compression spring 300 is attached to one end of the armature shaft 102. The unattached end of the armature compression spring 300 rests against a washer installed on the inside wall of the facet angle receiver 116. The armature shaft 102 protrudes through a hole in the wall of the facet angle receiver 116.

A nut and threaded connector are positioned on the armature shaft 102 protruding from the facet angle receiver 116. The facet angle selector 118 slides over the threaded connector positioned on the armature shaft 102. The facet angle selector lock 120, which encapsulates a nut, is threaded onto the end of the armature shaft 102 and compresses the facet angle selector 118 onto the threaded connector. A key in the facet angle receiver 116 fits into grooves placed in the facet angle selector 118 associated with the angle indicated on the body of the facet angle selector 118.

Operation—FIGS. 1, 2, 3: An object is affixed to a "dop" (a threaded coupler) using an adhesive. The dop is then threaded onto the jig's armature shaft 102 and locked in place with the object connector lock 100.

The face angle is selected using the armature collar tensioner 108, vertical height positioner 126 and vertical height lock 128. The vertical height positioner 126 raises or lowers the vertical collar 204 and armature collar 124. The armature collar tensioner 108 can be loosened to allow the armature shaft 102 to slide forward or back through the armature collar 124. These two actions are used to select the face angle of the art piece against the grinder. The face angle is indicated by lining up the indicator on the top of the armature collar 124 with the desired angle as shown on the face angle monitor mounted on the vertical collar 204. Once the desired face angle is set, the armature collar tensioner 108 and the vertical height lock 128 are tightened.

The facet angle is selected by loosening the facet angle selector lock 120 until the facet angle selector 118 can be pulled out of the facet angle receiver 116. The facet angle selector 118 is then rotated to the desired facet angle as noted on the facet angle selector 118. When the desired angle is selected, the armature compression spring 300 acting upon the armature shaft 102 pulls the facet angle selector 118 into the facet angle receiver 116, with the key within the facet angle receiver 116 holding the armature shaft 102 securely at the selected facet angle. The armature shaft lock 104 is then tightened against the armature shaft sleeve 106 to keep the armature shaft 102 from moving while the art piece is being ground. When the facet has been ground adequately using the selected grit disk, this step is repeated to select each of the desired facet angles for that face.

If multiple faces are to be ground, the armature collar tensioner 108, vertical height positioner 126 and vertical height lock 128 are used to set the next face angle as described in the paragraph on selecting the face angle. Each facet angle of the face are selected and ground as described in the paragraph on selecting the facet angle. Once all faces and facets have been ground and polished, the faceting of the art piece is complete.

Each facet angle selector 118 has a discrete number of possible angles. Multiple facet angle selectors 118 are provided, so a different set of angles can be used to facet an art piece. To exchange facet angle selectors 118, remove the facet angle selector lock 120 by twisting it off the armature shaft 102, slide the installed facet angle selector 118 off the armature shaft 102, slide the new facet angle selector 118 onto the armature shaft 102 and re-thread the facet angle selector lock 120 onto the armature shaft 102.

Advantages: From the description above, a number of advantages of some embodiments of my faceting jig become evident:

(a) The manufacture and construction of the faceting jig can be done economically enough to provide an accessible price point for the artist/hobbyist.

(b) The use of degrees on the angle selector provides a clear and obvious method of designing and selecting facets.

(c) Because the jig is independent of the grind wheel, it can be moved to work with multiple tools.

Conclusions, Ramifications and Scope: Accordingly, the reader will see that the faceting jig will provide an affordable entry point for artists and hobbyists to be able to facet objects. The mobility of the faceting jig allows function with multiple tools. Further, the faceting jig provides an accessible interface, including:

- allowing changes to both height and armature length as means to set the face angle;
- setting repeatable facet angles using the facet angle selector 118;
- allowing swappable facet angle selectors 118 to provide a wide range of facet angles.

The invention claimed is:

1. A faceting jig operable to set a face angle for grinding a facet upon an object mounted to the faceting jig, comprising:

- a base;
- a mast mounted to the base and projecting vertically upward from the base;
- an armature containment cylinder;
- a collar connecting the armature containment cylinder to the mast, the collar being operable to permit the armature containment cylinder to rotate to a selected angle between a vertical orientation and a horizontal orientation and being operable to move vertically between a plurality of locations upon the mast;
- a vertical height lock operable to suspend the collar at one of the plurality of locations upon the mast;
- an armature shaft disposed within the armature containment cylinder, wherein a longitudinal axis of the armature shaft is aligned with a longitudinal axis of the armature containment cylinder and wherein the armature shaft is operable to rotate about the longitudinal axis of the armature shaft;
- a facet angle selector affixed to an end of the armature shaft, wherein the facet angle selector is annotated with facet angle indicators ranging from zero degrees through three hundred and sixty degrees and is useful to select the facet angle of the object; and
- a facet angle selector lock affixed to the end of the armature shaft operable to lock a rotation of the armature shaft and selectably fix a facet angle of the object;

wherein the collar includes:

a vertical collar portion attached to the mast and being operable to move vertically between the plurality of locations upon the mast; and an armature collar portion attached to the vertical collar portion, attached to the armature containment cylinder, and being operable to rotate to the selected angle.

2. The faceting jig of claim 1, wherein the armature collar portion and the armature containment cylinder include mating key features operable to prevent the armature containment cylinder from rotating relative to the armature collar portion; and wherein the armature collar portion includes an armature collar tensioner providing for selective movement of the armature containment cylinder forward and back within the armature collar portion.

3. A faceting jig operable to set a face angle for grinding a facet upon an object mounted to the faceting jig, comprising:

a base;

a mast mounted to the base and projecting vertically upward from the base;

an armature containment cylinder;

a collar connecting the armature containment cylinder to the mast, the collar being operable to permit the armature containment cylinder to rotate to a selected angle between a vertical orientation and a horizontal orientation and being operable to move vertically between a plurality of locations upon the mast;

a vertical height lock operable to suspend the collar at one of the plurality of locations upon the mast;

an armature shaft disposed within the armature containment cylinder, wherein a longitudinal axis of the armature shaft is aligned with a longitudinal axis of the armature containment cylinder and wherein the armature shaft is operable to rotate about the longitudinal axis of the armature shaft;

a facet angle selector affixed to an end of the armature shaft, wherein the facet angle selector is annotated with facet angle indicators ranging from zero degrees through three hundred and sixty degrees and is useful to select the facet angle of the object;

a facet angle selector lock affixed to the end of the armature shaft operable to lock a rotation of the armature shaft and selectably fix a facet angle of the object; and a facet angle receiver connected to the armature containment cylinder; and wherein the facet angle receiver and the facet angle selector include a plurality of mating key features operable to enable selection between a plurality of preselected facet angles.

4. The faceting jig of claim 3, wherein the facet angle selector includes a first facet angle selector;

wherein the plurality of mating key features includes a first plurality of mating key features;

wherein the first facet angle selector is removeable; and further comprising a second facet angle selector operable to replace the first facet angle selector and including a second plurality of mating key features distinct from the first plurality of mating key features.

5. The faceting jig of claim 3, wherein the collar is operable to rotate about the mast.

6. A method for setting a face angle for grinding a facet upon an object with a faceting jig, comprising:

affixing the object to a first end of an armature shaft of the faceting jig, the faceting jig including:

a base;

a mast mounted to the base and projecting vertically upward from the base;

an armature containment cylinder;

a collar connecting the armature containment cylinder to the mast, the collar being operable to permit the armature containment cylinder to rotate to a selected angle between a vertical orientation and a horizontal orientation and being operable to move vertically between a plurality of locations upon the mast;

a vertical height lock operable to suspend the collar at one of the plurality of locations upon the mast;

the armature shaft disposed within the armature containment cylinder, wherein a longitudinal axis of the armature shaft is aligned with a longitudinal axis of the armature containment cylinder and wherein the armature shaft is operable to rotate about the longitudinal axis of the armature shaft;

a facet angle selector affixed to an end of the armature shaft, wherein the facet angle selector is annotated with facet angle indicators ranging from zero degrees through three hundred and sixty degrees and is useful to select the facet angle of the object; and a facet angle selector lock affixed to the end of the armature shaft operable to lock a rotation of the armature shaft and selectably fix a facet angle of the object;

selecting a facet angle of the object by rotating the facet angle selector relative to the armature containment cylinder;

locking the facet angle of the object by utilizing the facet angle selector lock;

moving the collar to one of the plurality of locations upon the mast; and rotating the armature containment cylinder to the selected angle;

wherein the collar includes:

a vertical collar portion attached to the mast and being operable to move vertically between the plurality of locations upon the mast; and an armature collar portion attached to the vertical collar portion, attached to the armature containment cylinder, and being operable to rotate to the selected angle;

wherein the armature collar portion and the armature containment cylinder include mating key features operable to prevent the armature containment cylinder from rotating relative to the armature collar portion;

wherein the armature collar portion includes an armature collar tensioner providing for selective movement of the armature containment cylinder forward and back within the armature collar portion; and further comprising utilizing the armature collar tensioner to move the armature containment cylinder within the armature collar portion.

7. The method of claim 6, further comprising grinding the facet upon the object.

8. The method of claim 7, further comprising, subsequent to grinding the facet upon the object:

unlocking the facet angle of the object by disengaging the facet angle selector lock;

rotating the facet angle selector relative to the armature containment cylinder to select a new facet angle; and locking the facet angle at the new facet angle by utilizing the facet angle selector lock.

9. The method of claim 7, further comprising, subsequent to grinding the facet upon the object, moving the collar to a second of the plurality of locations upon the mast.

10. The method of claim 7, further comprising, subsequent to grinding the facet upon the object, rotating the armature containment cylinder to a second selected angle.

11. The method of claim 6, wherein the faceting jig further includes a facet angle receiver connected to the armature containment cylinder;

wherein the facet angle receiver and the facet angle selector include a plurality of mating key features operable to enable selection between a plurality of preselected facet angles; and wherein rotating the facet angle selector relative to the armature containment cylinder includes rotating the facet angle selector until one of the plurality of mating key features align.

12. The method of claim 6, wherein the facet angle selector includes a first facet angle selector;

wherein the plurality of mating key features includes a first plurality of mating key features;

wherein the first facet angle selector is removeable; and further comprising replacing the first facet angle selector with a second facet angle selector including a second plurality of mating key features from the first plurality of mating key features.

13. The method of claim 6, further comprising rotating the collar about the mast.

* * * * *